US005154121A

United States Patent [19]

Schneider

[11] Patent Number: 5,154,121

[45] Date of Patent: Oct. 13, 1992

[54] SYSTEM AND METHOD TO APPLY A PRINTING IMAGE ON A PRINTING MACHINE CYLINDER HAVING INK ACCEPTING RECEPTORS OR CELLS, IN ACCORDANCE WITH ELECTRONICALLY FURNISHED IMAGE INFORMATION

[75] Inventor: Josef Schneider, Diedorf-Lettenbach, Fed. Rep. of Germany

[73] Assignee: Man Roland Druckmaschinen AG, Offenbach am Main, Fed. Rep. of Germany

[21] Appl. No.: 747,690

[22] Filed: Aug. 20, 1991

Related U.S. Application Data

[62] Division of Ser. No. 430,511, Nov. 1, 1989, Pat. No. 5,072,671.

[30] Foreign Application Priority Data

Nov. 9, 1988 [DE] Fed. Rep. of Germany ..... 3837897
Nov. 9, 1988 [DE] Fed. Rep. of Germany ..... 3837941

[51] Int. Cl.[5] ..... B41C 1/00

[52] U.S. Cl. ..... 101/401.1; 101/150; 101/170

[58] Field of Search ..... 101/401.1, 170, 150; 346/1.1, 140 R

[56] References Cited

U.S. PATENT DOCUMENTS 3,455,239 7/1969 Smith ..... 101/401.1 X
4,405,709 9/1983 Katano et al. ..... 101/401.1 X
4,729,310 3/1988 Love, III ..... 101/170 X

OTHER PUBLICATIONS

Donald, Philip J., "A Pre-Cavitated Rotogravure Plate and Method of Preparing Same for Printing", RCA Technical Notes, TN No. 828, Apr. 1969, 2 pp.

*Primary Examiner*—Clifford D. Crowder
*Attorney, Agent, or Firm*—Frishauf, Holtz, Goodman & Woodward

[57] ABSTRACT

To apply the negative of an image to be printed to a printing form (1, 1701), the receptors or cells (7, 1704) of the printing form are first made to have the maximum size required for transfer of the necessary quantity of ink to a substrate (12) and the cells are then, selectively, filled with a flowable, solidifiable substance (9, 1704*a*), in accordance with the printed image. The quantity of substance (9) introduced into gravure cells (7) can be inversely proportional to the quantity of ink to be transferred to the substrate (12) and injected, for example by a spray of ink jet device similar to an ink jet printer, into the cells under control of a control unit (M), the melted substance solidifying upon contact with the gravure form (1). In a screen printing from, the substance can fill the interstices of the screen, forming the cells (1704). After printing, the form which, if a gravure form, preferably is a seamless ceramic cylinder, can be re-programmed by re-use by cleaning the form to be free from ink, then melting-out the solidified prior substance, assisted for example by wiping, suction, compressed air or hot air blowing or blotting, and then re-imaging the printing form in accordance with new image information by introducing molten, then solidifying substance into the cells in accordance with the new image information.

18 Claims, 3 Drawing Sheets

SYSTEM AND METHOD TO APPLY A PRINTING IMAGE ON A PRINTING MACHINE CYLINDER HAVING INK ACCEPTING RECEPTORS OR CELLS, IN ACCORDANCE WITH ELECTRONICALLY FURNISHED IMAGE INFORMATION

This application is a division of U.S. application Ser. No. 07/430,511, filed Nov. 1, 1989, U.S. Pat. No. 5,072,671, Dec. 17, 1991.

FIELD OF THE INVENTION

The present invention relates to printing machines and a method to apply a printing image on a printing machine cylinder having ink accepting receptors or cells, in accordance with electronically furnished image information, and more particularly to apply the printing image directly on a printing cylinder without requiring placement of an unchangeable or unvarying image carrying plate or surface on the printing cylinder.

BACKGROUND

German Patent 32 48 178 described a method for use with an offset printing machine in which digital image information is applied to a recording head which, selectively, causes melting of meltable substance particles located on a thermo transfer foil, so that the thermo transfer foil will have placed thereon a representation of the digital information in form of ink-accepting, i.e. oleophilic, and ink-repellent or, respectively, water-repellent, i.e. hydrophobic, and water-accepting, i.e. hydrophilic areas. The thermo transfer foil, which carries the information in point form, is then engaged against a printing cylinder for direct transfer of the information thereto.

The point-form energy application, specifically heat, corresponds to the electronic image information. An oleophilic or ink-accepting substance, coating the thermo transfer foil, is dissolved off, and applied to the printing cylinder. This system is complex since the transfer is in image point units, and can be applied, at any time, only to a single printing cylinder. The time taken to transfer the image to a printing cylinder is substantial due to the point-by-point transfer of the image information.

High-quality printing can be obtained by using cylinders having ink accepting receptors or cells. In a gravure printing system, the cylinder is formed with tiny receptor depressions or cells, located between a ridge pattern; in a screen printing system, the ink receptors are formed by the interstices between the screen filaments or elements. The receptors or cells can be formed by mechanical, electromechanical, electrothermal, or chemical material removal, in part, if desired, with intermediate photo-optic or chemical auxiliary processes. The receptors, to receive different quantities of ink, have different size, depth or spacing from each other. Methods to make gravure printing cylinders of this type, or screen cylinders with varying cell size or location, are expensive and complex, and must be carefully controlled. The numerous steps required thereby take much time and effort. Printing cylinders which, in large machines, can be unwielding and weigh up to several tons, have to be removed from the machine to make a new printing cylinder, in negative form. The imaging of these new cylinders, then, has to be carried out in large machines, and the then imaged cylinders have to be returned to the printing machines. Thus, gravure printing, although it provides high-quality printed subject matter, is economically suitable only if a very high number of copies or editions are required; likewise screens often are used to make many printed products.

DEFINITION

The term "printing form" as used herein defines a printing machine element which has a surface with ink applying surface portions and non-inking surface portions, for subsequent transfer of printing information onto a substrate, and thus is used in the extended sense of the ƀforme" described, for example, in "Machine Printing" by Durant, Meacock & Whitworth, Hastings House, Publishers, New York, N.Y. Copyright 1973, applied both to a planographic as well as a gravure form and not only to a raised-letter or letterpress form (or forme, in the British spelling).

THE INVENTION

It is an object to provide a system and a method to generate printing cylinders having ink accepting receptors or cells carrying printing images which operates rapidly and efficiently and which is versatile, economical, and does not require extensive apparatus separate from the printing machine, or incompatible therewith.

Briefly, a printing cylinder is made with receptors and cells for the reception of ink therein, the cells having a size sufficient to accept the maximum quantity of ink to be transferred to a printing substrate. In accordance with a feature of the invention, a recording head selectively applies a liquefiable and solidifiable substance into the respective cells of the form, controlled by a control unit, to fill the receptors and cells with predetermined quantities of the solidifiable substance, in order to permit control of the quantity of ink which any specific receptor and cell can accpet—or, upon completely filling the receptor or cell—rejecting reception of any ink.

The substance can be applied directly to the receptors or cells, for example by an applicator similar to an ink jet applicator used in computer output printers. The material applied is normally a substance which, upon heating, can be liquefied, and ejected under pressure. The time and course as well as the quantity of ejection can be controlled analogously to the ink jet principle. A thermoplastic material or a wax is suitable for the material being ejected and introduced into the cells or receptors.

In accordance with a feature of the invention, the printing form is a gravure cylinder form, in which the cells have a depth sufficient to accept the maximum quantity of ink to be transferred; the quantity of injected materials filling the cells can be inversely proportional to the amount of ink to be transferred, so that the quantity of ink can be directly controlled from an electronic control unit.

In accordance with another feature of the invention, the printing form is a screen printing form, of well known construction, for example a woven screen or a perforated foil. The material being applied to the screen printing form, again, can be applied by a spray or ejector mechanism, similar to an ink jet applicator used in computer output printers, in which the respective openings or interstices between the material forming the screen are selectively closed to prevent the passage of ink therethrough. Those interstices or cells which have been closed, then, will not transfer ink upon subsequent printing.

DRAWINGS

DETAILED DESCRIPTION

Figure 1:
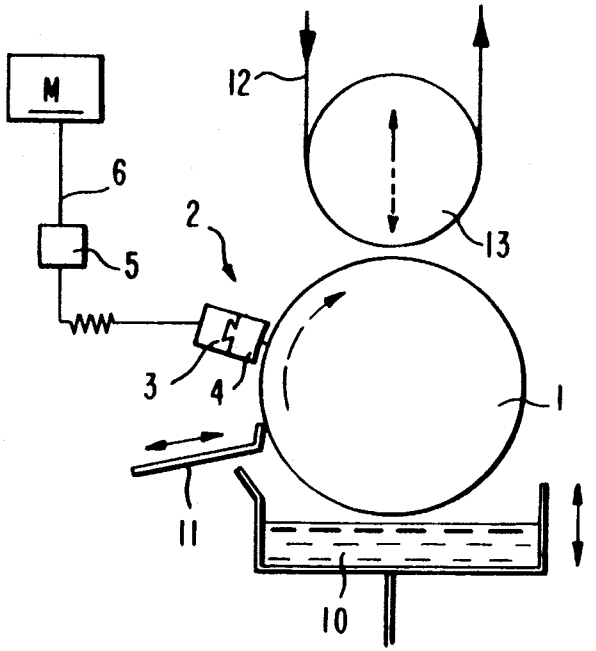
FIG. 1 is a highly schematic side view of a printing arrangement for a gravure printing machine in which the gravure cylinder is directly prepared for gravure printing.

Referring now to FIG. 1, which illustrates the application of the present invention to a gravure cylinder: Cylinder 1 is a gravure cylinder of a customary rotary gravure printing machine. An image forming unit 2 is applied against the cylinder 1, the unit 2 being capable of traveling axially with respect to the cylinder 1 guided in a guide track 3. The unit 3 carries the actual application head 4 which has at least one nozzle through which a liquefied, but normally solid substance is sprayed on the gravure cylinder 1, under pressure. The amount of substance being sprayed, that is, for how long, how much, and under what pressure, is controlled by a control unit 5, similar to control of an ink jet printer, and receiving control signals from a control line 6 which, in turn, is controlled by an image storing memory M, including, of course, the customary circuitry to convert the information stored in the memory into suitably timed digital signals for handling by the unit 3 and the jet 4. The control unit 5 reads the signals, received in digitally coded form, from the memory M. Transfer of information from the memory via the control unit 5 is in point-by-point form, line or row by line, on the cylinder 1. In accordance with a preferred feature of the invention, a plurality of nozzles, located next to each other in circumferential direction of the cylinder 1, can be used, so that a plurality of lines can be recorded on the cylinder 1 in parallel. The range of information which can be recorded on the cylinder 1, that is, the variation in quantity of the transferred substance, is preferably based on one byte of information for each pixel or image point, which provides for 356 possible variations in ink density.

Figure 2:
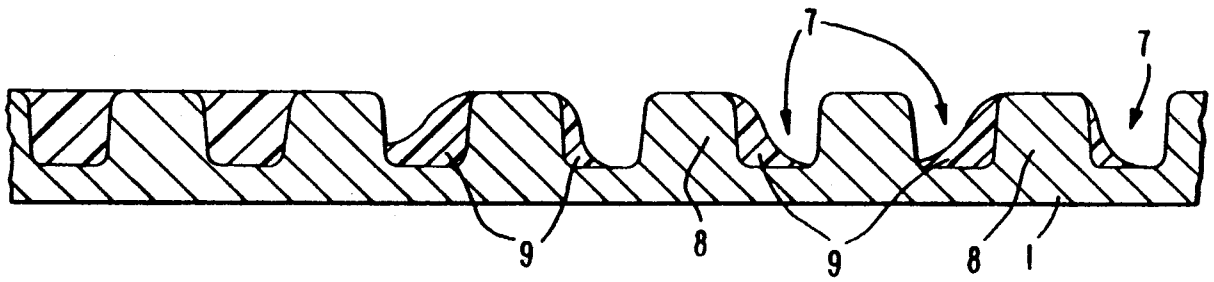
FIG. 2 illustrates, in enlarged representation, application of image controlling substances to the cells of the gravure cylinder.
Figure 3:
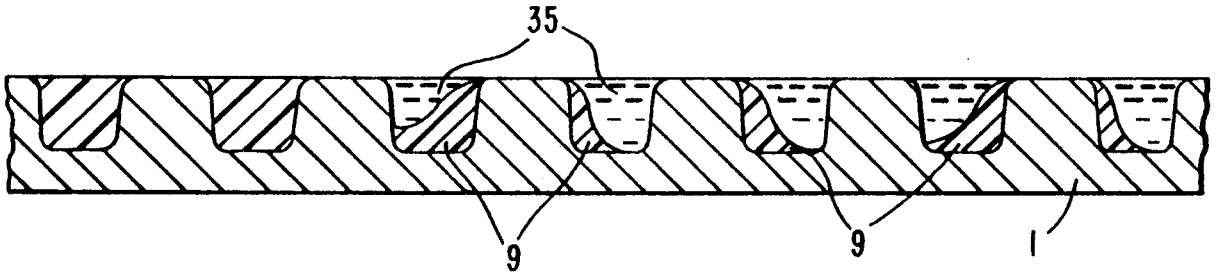
FIG. 3 shows the gravure cylinder of FIG. 2 after inking.

The surface of the printing cylinder 1 is shown in detail and to a much larger scale in FIG. 2; it has a plurality of receptor recesses or cells 7, separated from each other by separating strips or ridges 8. This is standard gravure printing cylinder construction. The depth of the cells 7 is so selected that it can hold at least the maximum quantity of ink to be transferred to a substrate, for example a sheet or a web 12 (FIG. 1).

The quantity of liquefied substance injected by the unit 2 into the receptor 7 will be inversely proportional to the image information. Upon contact with the surface of the gravure cylinder 1, which is colder than the molten substance, the substance will solidify or harden immediately to form a partial filling, in form of layers or obstructions 9 on the base and on the edge of the receptors 7. Upon subsequent inking of the surface of the gravure cylinder 1, only so much ink 35 can be filled into the receptors 7 until the volume is flush with the surface; thus, the volume of ink will correspond to the volume of the receptors 7 less the fillings 9.

After the cylinder has been prepared, so that its surface will have the form shown in FIG. 2, the imaging unit 3 is removed from the cylinder and it is ready to print. First it has to be inked, which can be done as well known, by dipping the cylinder 1 into an ink trough 10 (FIG. 1). Excess ink can be removed by a doctor blade unit 11 which can be further so placed that any excess ink is returned immediately to the ink trough 10. The doctor blade 11 will ride on the ribs 8. The now inked image, carrying as much ink 35 as the respective receptors can hold, is then applied to a substrate web 12, looped about a suitable impression cylinder 13, which is then moved in contact with the cylinder 1, with the web 12 interposed.

Any thermoplastic material or wax is suitable as the transfer substance to be applied in the cells 7.

Figure 4:
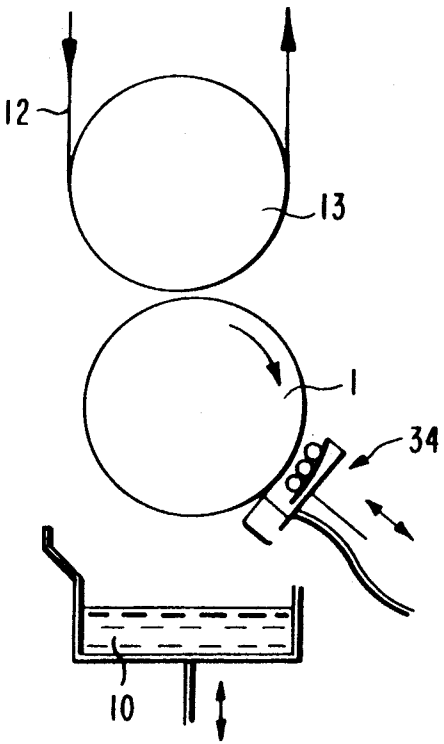
FIG. 4 is a schematic portion from a gravure printing machine illustrating an erasing system for the gravure printing cylinder.

One of the advantages of this system is that the expensive gravure cylinders can be easily reused for different images. After finishing printing, new image material can be easily applied thereto. The gravure cylinder is cleaned to remove remnants of ink. Referring to FIG. 4: After cleaning of the cylinder, an erasing system 34 is engaged against the respective cylinder 1, which supplies sufficient heat to liquefy the thermoplastic substance 9 previously applied thereto, and the, by means of a blower and/or suction, removes the liquefied wax and/or thermoplastic material. Blotting tapes or sheets can also be used, which such up the re-liquefied substance 9 by capillary or wicking action between interstices of felting or woven knitted blotting material.

The gravure cylinder 1 preferably is seamless and made of ceramic material, which has high wear resistance and is highly resistant against heat. Such gravure cylinders have a long lifetime, and are capable of carrying many different forms of printed image, and can be easily re-used with different printed subject matter. Even if the printed subject matter changes often, the high quality obtainable with gravure printing can be achieved. At the same time, wear and tear of the doctor blades 11, engaged against the cylinders, is reduced when they slide on the ribs or ridges of the ceramic material.

Figure 5:
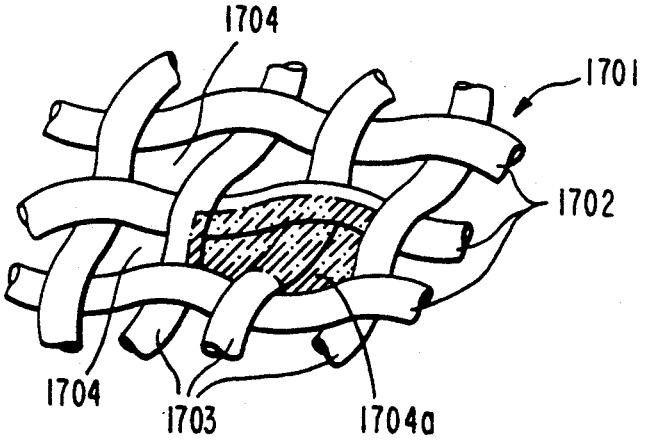
FIG. 5 is a highly schematic view of a fragment of a screen of a screen printing form, illustrating application of image controlling substance to the cells of the screen printing form.

FIG. 5 illustrates a printing screen 1701. The screen has longitudinal or warp filaments 1702 and transverse or weft filaments 1703. The filaments of threads or yarns 1702, 1703 form solid portions leaving openings or interstices 1704.

A quantity of liquefied substance is ejected from the unit 2 (FIG. 1) against the screen 1701, to cover or fill selected interstices 1704, as seen at 1704*a*. The image memory M, which provides digitally stored information, thus can control whether any openings 1704 of the screen 1701, selectively, will transfer ink or not transfer ink, in accordance with command bits stored in the memory. If at any position of the finished screen print no ink is to be applied, one or more of the ink ejectors or injectors 4 is energized and the respectively energized elements will melt the meltable substance in a locally precisely limited region, so that the molten substance can be ejected and penetrate within the openings of the mesh of the printing screen, where it will immediately solidify, and close off the interstices 1704, as seen schematically at 1704*a*.

Information transfer can be bit-by-bit, serially, or when using for example a plurality of thermal units, in 8-bit parallel. By use of appropriate signal processors, memories, and data buses, information transfer can, of course, also be carried out in a greater width, for example 32-bit parallel, which then permits controlling a corresponding larger number, for example 32, of ink ejectors.

The substance introduced in the cells of the screen printing form can be reinforced by applying a material which cures or hardens the substance applied to the cells of the screen.

The information applied on the screen 1701 can be easily erased. After printing, the screen is cleaned and any remanent ink particles are removed. The screen is then heated and the liquefied particles of the substance 1704*a* are removed by blowing off with hot air, wiping or the like. Thus, a single screen print form, as well as the substance which can readily be recuperated, can be re-used as often as desired, thus substantially improving the economics of operation as well reducing waste and trash which may have to be removed.

I claim:

1. A method of applying a printing image requiring specific quantities of ink at discrete locations of the image of a printing form (5, 1701) having ink accepting receptors or cells, wherein said form is formed with receptors or cells (7, 1704) or uniform size for the reception of ink (35) therein for transfer to a printing substrate (12) for reproduction of said printing image, and said receptors or cells have a size sufficient to accept the maximum quantity of ink to be transferred to said printing substrate (12).

comprising the steps of controlling the volume available for reception of ink of selected receptors or cells by introducing, in liquid state, a solidifiable substance into the respective receptors or cells of the form; and controlling the introduction of the substance being introduced into selected individual receptors or cells as a function of the specific quantity of ink required to reproduce the discrete locations of the image.

2. The method of claim 1, wherein said substance is heat-meltable and applied into the receptors or cells (7) of said printing form (1) by at least one of:

spraying;

injecting.

3. The method of claim 1, wherein the step of controlling the introduction of the substance includes controlling the quantity of said substance introduced into the respective receptors or cells (7) to be inversely proportional to the quantity of ink to be transferred from said printing form (1) to said substrate.

4. The method of claim 3, wherein said form is a gravure printing form.

5. The method of claim 4, further including the step of stripping excess substance off the surface of the gravure form by a doctor blade (11).

6. The method of claim 4, wherein said step of stripping excess substance off the surface of the gravure form comprises stripping said substance off the form by a heated doctor blade.

7. The method of claim 1, further including the step of removing solidified substance (9, 1704*a*) from said receptors or cells by re-melting said substances and then removing said re-melted substances from said depressions or cells.

8. The method of claim 1, wherein said receptors or cells have ink applied therein; further including the steps of removing the ink from the receptors or cells (7, 1704) of the printing form (1), to thereby clean the surface and said receptors or cells and hence said printing form (1); and removing, by re-melting said substance (9, 1704) from said receptors or cells (7, 1704) to thereby provide said form with said receptor depressions or cells of a size sufficient to accept the maximum quantity of ink for subsequent re-use to apply a subsequent printing image, upon subsequently introducing further solidifiable substance in accordance with a further image.

9. The method of claim 1, wherein said printing form is a gravure printing form, including the step of erasing and removing image information carried by said gravure printing form (1), said step comprising heating the substances (9) within the receptors or cells (7) of the printing form, to melt said substances; and removing said melted, and hence liquefied substances, from said receptors or cells (7) of the printing form by at least one of:

wiping said form;

applying suction means to said receptors or cells (7);

applying compressed air blow into said receptors or cells (7);

applying a blotting means against said receptors or cells.

10. The method of claim 1, wherein said form is a screen printing form and said step of introducing the solidifiable substance comprises completely filling said receptors or cells (1704).

11. The method of claim 10, further including the step of mechanically reinforcing the substance transferred to the screen printing form by applying a material having the characteristic of hardening or curing or reinforcing said substance applied to the screen printing form.

12. The method of claim 1, wherein said printing form is a screen printing form, including the step of erasing and removing image information carried by said screen printing form (1701), said step comprising heating the substances (1704*a*) within the receptors or cells (1704) of the printing form, to melt said substances; and removing said melted and hence liquefied substances from said receptors or cells (1704) of the printing form by at least one of:

blowing off with hot air;

wiping.

13. Apparatus for applying a printing image on a printing machine printing form (1, 1701) having ink accepting receptors or cells requiring specific quantities of ink at discrete locations of the image, in accordance with image information provided by an electronic memory (M), wherein said printing form (1, 1701) is formed with receptors or cells (7, 1704), which are uniform and of sufficient size to accept the maximum quantity of ink to be transferred to a substrate (12), comprising means for controlling the quantity of ink which can be accepted in said receptors or cells in accordance with the specific ink requirement in the respective receptors or cells at said specific locations to thereby reproduce said image, by selective control of the volume of the receptors or cells available for reception of ink, including means (3, 4) for introducing into said receptors or cells (7) of uniform size a filler substance (9, 1704*a*) in flowable form, said filler substance being solidifiable; and a control unit (M, 5, 6) coupled to an controlling said introducing means (3, 4) to introduce said filler substance into the respective receptors or cells (7, 1704) as a function of the specific quantity of ink required to reproduce the discrete locations of the image, to selectively, and under control of said control unit, change the volume of the respective receptors or cells available for reception of ink.

14. The apparatus of claim 13, wherein said substance introducing means (3, 4) comprises means for melting said substance; and an ejection means ejecting into said receptors or cells (7) said liquefied substance under control of said control unit (M, 5, 6), said substance hardening or solidifying within said receptors or cells.

15. The apparatus of claim 13, wherein said printing form comprises a gravure form having a continuous and seamless ceramic surface, said surface being formed with said receptors or cells (7).

16. The apparatus of claim 13, wherein said printing form comprises a gravure form;

and said control unit (M, 5, 6) controls the quantity of filler substance being ejected by the introducing means (3, 4) to be representative of the inverse of the quantity of ink (35) to be transferred to said substrate in accordance with image information.

17. The apparats of claim 13, including inking means (10) for inking said gravure printing form after said receptor depressions or cells (7) have been filled with said substance (9), said inking means applying ink into the space of the receptor depressions or cells (7) which is left after said substance (9) has been introduced in quantities inversely proportional to the quantity of ink to be transferred to said substrate (12); and doctor blade means (11) stripping excess ink from the surface of said form.

18. The apparatus of claim 13, wherein said printing form comprises a screen printing form (1701); and wherein said control unit (M, 5, 6) coupled to an controlling said introducing means controls introduction of ink to the respective receptors or cells (1704) to fill said receptors or cells, in accordance with image information, and block transfer of ink through the fill receptors or cells where no ink is to be transferred to said substrate.

* * * * *